US009754577B2

(12) United States Patent
Gaiffe et al.

(10) Patent No.: US 9,754,577 B2
(45) Date of Patent: Sep. 5, 2017

(54) ACOUSTIC DEVICE CAPABLE OF PRODUCING ACTIVE NOISE REDUCTION

(71) Applicant: ELNO, Argenteuil (FR)

(72) Inventors: Thierry Pierre François Gaiffe, Saint Germain en Laye (FR); Patrick Jean François Robuchon, Les Essarts le Roi (FR); Julie Marie Anne Rosier, Auvers sur Oise (FR); Eric Bernard Jacques Clowez, Bois Colombes (FR)

(73) Assignee: ELNO, Argenteuil (FR)

( * ) Notice: Subject to any disclaimer, the term of this patent is extended or adjusted under 35 U.S.C. 154(b) by 0 days.

(21) Appl. No.: 14/893,188

(22) PCT Filed: May 23, 2014

(86) PCT No.: PCT/EP2014/060683

§ 371 (c)(1),
(2) Date: Mar. 28, 2016

(87) PCT Pub. No.: WO2014/187967

PCT Pub. Date: Nov. 27, 2014

(65) Prior Publication Data

US 2016/0203813 A1 Jul. 14, 2016

(30) Foreign Application Priority Data

May 23, 2013 (FR) ..... 13 54634

(51) Int. Cl.
*G10K 11/178* (2006.01)
*H04R 1/10* (2006.01)
*H04R 3/00* (2006.01)

(52) U.S. Cl.
CPC ..... *G10K 11/1788* (2013.01); *G10K 11/178* (2013.01); *H04R 1/1083* (2013.01);
(Continued)

(58) Field of Classification Search
CPC ..... H04R 1/1083; H04R 3/02; H04R 25/606; H04R 2460/13; G10K 2210/3055; G10K 2210/3229; G10K 11/1788
See application file for complete search history.

(56) References Cited

U.S. PATENT DOCUMENTS

2011/0135106 A1* 6/2011 Yehuday ..... H04R 1/1083 381/71.6
2013/0142348 A1* 6/2013 Weisman ..... H04R 1/1083 381/66
2013/0156202 A1* 6/2013 Hamacher ..... H04R 25/453 381/23.1

FOREIGN PATENT DOCUMENTS

JP 2006-325895 A 12/2006
WO 2007/107985 A2 9/2007
WO 2010/052720 A1 5/2010

OTHER PUBLICATIONS

French Search Report dated Mar. 4, 2014 issued in corresponding French Patent Application No. 1354634.
(Continued)

*Primary Examiner* — Sonia Gay
(74) *Attorney, Agent, or Firm* — Troutman Sanders LLP

(57) ABSTRACT

The invention relates to an acoustic device capable of producing active noise reduction, which may be positioned on the head of a user, comprising at least one microphone capable of sensing a sound signal representative of ambient noise, including at least one active noise reduction acoustic module comprising an osteophonic transducer, capable of being positioned on a side flank of the head of the user and of transmitting a vibratory signal transformed by bone conduction into an acoustic signal which may be perceived by the user, connected to said microphone, while said at least one acoustic module includes an electronic circuit capable of
(Continued)

generating a vibratory signal giving the possibility of attenuating perception of said ambient noise by the user.

5 Claims, 4 Drawing Sheets

(52) U.S. Cl.
CPC ..... *H04R 3/00* (2013.01); *G10K 2210/3055* (2013.01); *G10K 2210/3229* (2013.01)

(56) References Cited

OTHER PUBLICATIONS

International Search Report dated Sep. 5, 2014 issued in corresponding PCT Application No. PCT/EP2014/060683.

* cited by examiner

ACOUSTIC DEVICE CAPABLE OF PRODUCING ACTIVE NOISE REDUCTION

CROSS-REFERENCE TO RELATED APPLICATIONS

This application is the U.S. National Phase of International Patent Application Serial No. PCT/EP2014/060683, filed May 23, 2014, which claims priority to French Patent Application No. 1354634, filed May 23, 2013, both of which are herein incorporated by reference in their entireties.

FIELD OF THE INVENTION

The present invention relates to an acoustic device capable of producing active noise reduction, which may be positioned on the head of a user.

The invention is located in the field of active noise reduction.

BACKGROUND

There exist various acoustic devices for reducing ambient noise, notably headphones including an active noise reduction system. Generally, such headphones include two microphones, conventionally positioned on the ears of a user. Each earphone is equipped with a microphone capable of sensing a sound signal representative of ambient noise, said noise signal. Active noise reduction is then produced by emitting through the earphones, at the inlet of the ear canal of the user, an airborne sound signal which is calculated in order to compensate for the sensed noise signal, also called « counter-noise » .

SUMMARY

The object of the invention is to propose an acoustic device for ambient noise reduction giving the possibility of better attenuation of noise without being cumbersome for the user.

For this purpose, the invention proposes an acoustic device capable of producing active noise reduction, which may be positioned on the head of a user, comprising at least one microphone capable of sensing a representative sound signal of an ambient noise. The acoustic device includes at least one acoustic module for active noise reduction comprising an osteophonic transducer, able to be positioned on a side flank of the head of the user and of transmitting a vibratory signal transformed by bone conduction into an acoustic signal which may be perceived by the user, connected to said microphone, while said at least one acoustic module includes an electronic circuit capable of generating a vibratory signal giving the possibility of attenuating the perception of said ambient noise by the user.

Advantageously, the acoustic device according to the invention includes an osteophonic transducer capable of applying active noise reduction. Thus, in an embodiment, congestion for the user is minimum, no obturation of the ears being required for achieving active noise reduction.

The acoustic device according to the invention may also have one or several of the features below, taken independently or as a combination:

said electronic circuit implements a filter defined by a noise reduction transfer function, said transfer function being determined so as to achieve noise attenuation depending on direct bone conduction between the osteophonic transducer and the inner ear of a user located on the same side as said transducer;

said noise reduction transfer function depends on a ratio of a direct bone conduction transfer function representative of said bone conduction and of an airborne conduction transfer function representative of the conduction of an airborne acoustic signal between an outer ear and an inner ear located on a same side;

said transfer function is defined by the formula:

$$H_{FO} = -R \cdot \frac{H_b^G}{H_m \cdot H_{TO}}$$

wherein R is said ratio of a direct bone conduction transfer function and of the airborne conduction transfer function, $H_b^G$ is a characteristic transfer function of the ambient noise, $H_m$ is the transfer function of said microphone and $H_{TO}$ is the transfer function of said osteophonic transducer;

it includes two so called active noise reduction acoustic modules able to be positioned on opposite lateral sides of the head of a user;

each active noise reduction acoustic module includes an osteophonic transducer and an electronic circuit implementing a filter defined by a noise reduction transfer function, said transfer function being determined according to direct bone conduction and to transverse bone conduction of a vibratory signal from the opposite osteophonic transducer;

it further includes an active noise reduction module by transmission of an airborne counter-noise signal.

BRIEF DESCRIPTION OF THE DRAWINGS

Other features and advantages of the invention will become apparent from the description given thereof below, as an indication and by no means as a limitation, with reference to the appended figures, wherein.

DETAILED DESCRIPTION

Figure 1:
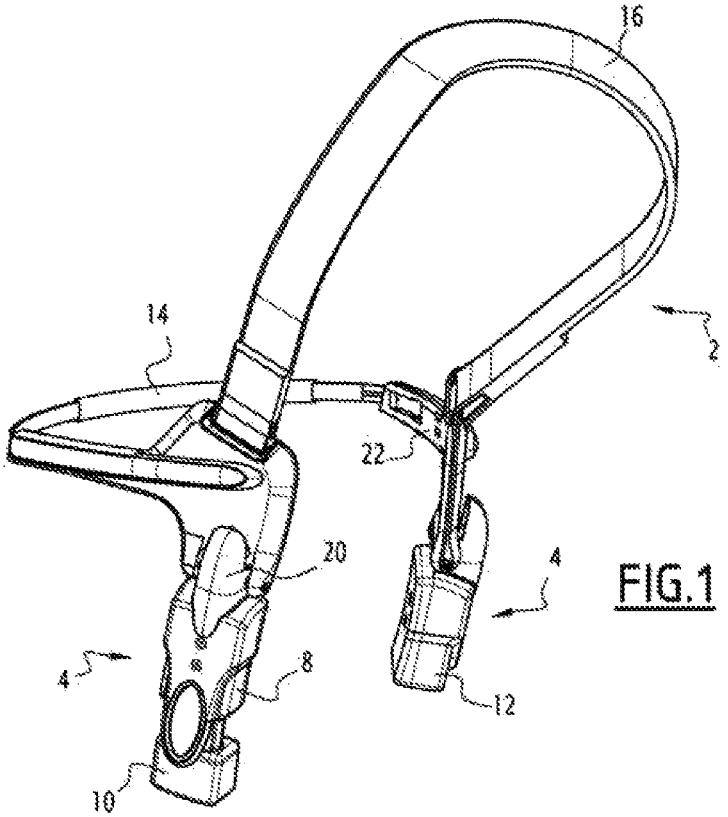
FIG. 1 is an overall view of an acoustic device according to an embodiment of the invention.

The acoustic device 2 of FIG. 1 comprises two active noise reduction side acoustic modules 4 via an osteophonic route which are similar. The acoustic device 2 is adapted so as to be positioned on the head of a user (not shown), the side acoustic modules 4 being positioned in contact with the skull of the user, preferably at his/her temples.

An acoustic module 4 comprises an osteophonic transducer 8 and a casing 10, including a microphone capable of sensing a sound signal representative of an ambient sound, typically ambient noise.

The osteophonic transducer 8 includes a transmitter element not shown, capable of transforming a sound signal into a vibratory signal, transmitted to the auditory nerve of the user by bone conduction. Thus, a sound signal transformed by bone conduction into an acoustic signal which may be perceived by the user at his/her inner ear. The transmitter element is protected by a protective shell 12, which preferably consists of two half-shells fitted together. The half-shells for example are in plastic material and injection-molded.

The casing 10 also includes an electronic card not shown, which will be described in more detail with reference to FIG. 2, and which is connected to the microphone for sensing ambient sound and which comprises an electronic filtering circuit giving the possibility of generating from the sensed sound signal, a so called "counter-noise" electric signal, transformed into a vibratory signal by the osteophonic transducer 8 and able to reduce or completely cancel the perception of the ambient sound signal at the auditory nerve of the user. Thus, in an embodiment, an ambient sound wave is cancelled out by bone conduction.

The acoustic device 2 also includes a mechanical maintaining member 14, which in this example is a rigid head band capable of supporting the acoustic modules 4 in an adequate position, pressing against the temples of the user. Preferably, the rigid head band 14 has an adjustable length.

Further, optionally, the acoustic device 2 also includes an additional maintaining member 16, which, in this exemplary embodiment is a flexible head band 16, preferably with adjustable length, which may be positioned on the top of the head of the user in order to ensure a reliable hold.

A joint 20, between a part 22 for attaching an acoustic module 4 to the maintaining members 14, 16 is also provided. The joint 20 is able to allow adequate positioning of the acoustic modules on the head of a user. In an embodiment, the joint 20 is equipped with a spring not shown, able to ensure return of the acoustic module 4 to a rest position.

According to a simplified alternative not shown, the acoustic device according to the invention is equipped with a single side acoustic module for active noise reduction, positioned on a single side of the skull of the user.

It is understood that the noise reduction acoustic modules 4 via an osteophonic route are illustrated and described in detail.

However, any acoustic device or headphone, including such acoustic modules is part of the invention.

According to an alternative, one or two noise reduction acoustic modules 4 via an osteophonic route are integrated into a conventional noise reduction device, of the anti-noise headphone type, in order to combine noise reduction via an air route by generating an airborne counter-noise acoustic signal and noise reduction via an osteophonic route.

Figure 2:
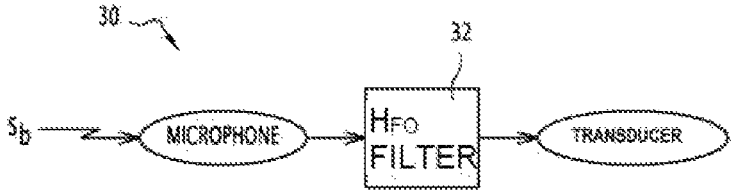
FIG. 2 schematically illustrates an electronic card of the acoustic device according to the invention.

An electronic card 30 according to the invention is illustrated in FIG. 2. An ambient noise signal Sb is sensed by the microphone. A filtering module 32 is connected to the microphone, this module applying a transfer function $H_{FO}$ allowing determination of the electric signal, equivalent to within the gain and the phase, to the osteophonic signal to be transmitted by bone conduction in order to cancel out the noise signal Sb.

According to a first embodiment, the transfer function $H_{FO}$ is determined by an acoustic device 2 provided with a single noise reduction acoustic module 4 via an osteophonic route. The thereby determined transfer function $H_{FO}$ is also applied in the case of an acoustic device 2 provided with right and left acoustic modules 4, but assuming equivalent ambient noise conditions at the right and left ears of the user, and by only considering direct bone conduction.

Figure 3:
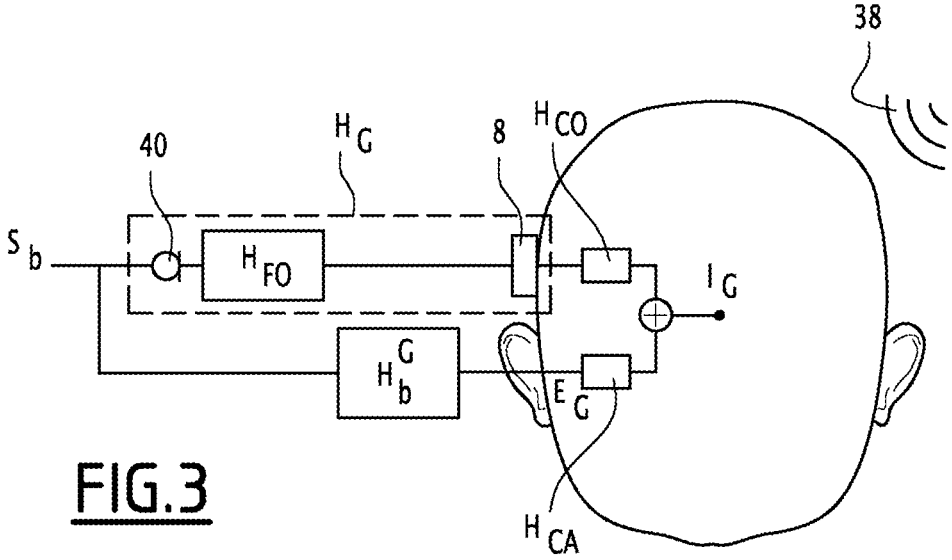
FIG. 3 is a block diagram of active noise reduction according to a first embodiment.

In order to explain how to determine the transfer function $H_{FO}$ in this first embodiment, FIG. 3 schematically illustrates the principle for reducing noise via an osteophonic route in this embodiment.

In this example, the case of an acoustic module 4 placed on the left lateral side of the user is considered. It is understood that the principle described hereafter applied symmetrically when an acoustic module 4 is placed on the right lateral side of the skull of the user.

Only the transducer 8 belonging to the acoustic module 4 is illustrated. Point $I_G$ represents the left inner ear of the user and point $E_G$ the entry point of the left auditory conduit or outer ear.

Noise sound waves 38 are transmitted through air, and sensed by the microphone 40. According to basic modeling, a transfer function $H_{CO}$ defines the conduction via a bone route between the transmission of a vibratory signal by the transducer 8 and the inner ear $I_G$. The overall transfer function between the input of the microphone 40 and the transmission of an osteophonic vibratory signal is noted as $H_G$. Similarly, a transfer function $H_{CA}$ represents the conduction of an airborne sound signal between the outer ear $E_G$ and the inner ear $I_G$, this is the transfer function of the inner and medium ear. The transfer function $H_b{}^G$ is the characteristic transfer function of the noisy environment, also used within the scope of conventional noise reduction.

In order to cancel out the noise at the inner ear $I_G$ of the user, the following relationship has to be verified:

$$H_G \cdot H_{CO} = -H_{CA} \cdot H_b{}^G \quad \text{(Eq 1)}$$

The result of this is that the overall transfer function $H_G$ depends on the ratio R between the transfer function $H_{CA}$ of the outer and medium ear and the transfer function $H_{CO}$ of bone conduction:

$$H_G = -\frac{H_{CA}}{H_{CO}} \cdot H_b^G \quad \text{(Eq 2)}$$

Further, if the transfer function of the microphone 40 and the transfer function of the transducer 8 are respectively noted as $H_m$ and $H_{TO}$, the following relationship is also verified:

$$H_G = H_m \cdot H_{FO} \cdot H_{TO} \quad \text{(Eq 3)}$$

By combining the relationships (Eq 2) and (Eq 3) above, the result is:

$$H_{FO} = -\frac{H_{CA}}{H_{CO}} \cdot \frac{H_b^G}{H_m \cdot H_{TO}} = -R \cdot \frac{H_b^G}{H_m \cdot H_{TO}} \quad \text{(Eq 4)}$$

In order to determine the transfer function $H_{FO}$ to be applied, it is therefore useful, in a preliminary phase, to determine the $R = H_{CA}/H_{CO}$ ratio, which in other words amounts to determining the equivalent airborne sound signal, to within the gain and the phase, to the osteophonic vibratory signal.

Figure 4:
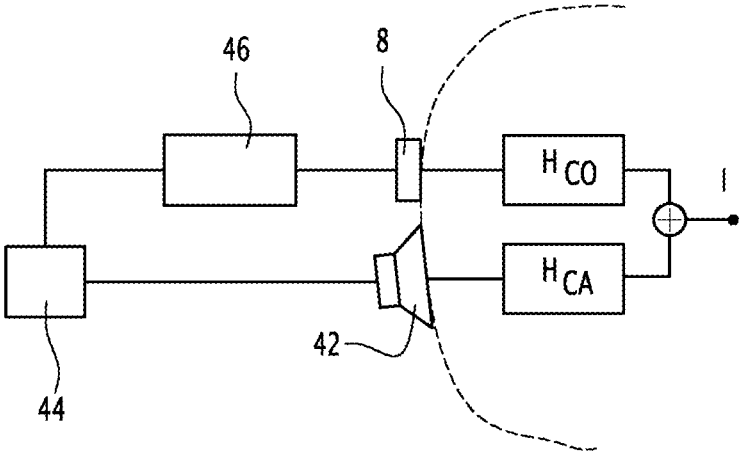
FIG. 4 schematically illustrates a procedure for measuring the direct bone conduction transfer function.

Such a determination is carried out, in an embodiment according to the procedure schematized in FIG. 4. A human operator is involved in this experimental determination.

As illustrated in FIG. 4, the tested operator is equipped with a transducer 8, positioned sideways, substantially in the region of the temple, and with an earphone 42 positioned on one ear, for example the left ear like in the example of FIG. 3. The earphone 42 is a standard earphone, allowing transmission of an airborne acoustic signal at the left outer ear of the operator. Preferably, the right outer ear is obstructed, for example with an ear plug, in order to avoid possible auditory interference.

A generator 44 of sinusoidal signals gives the possibility of successively generating signals for a set of frequencies varying from 20 Hz to 20 kHz. A generated sinusoidal signal is transmitted both to the earphone 42 and to a filter 46, for which the gain Go and the phase ΔΦo are adjustable by the operator. The operator has the possibility of adjusting the gain and the phase of the filter 46 for a sinusoidal signal of a given frequency f until a canceling out of the perceived sound is ascertained at his/her inner ear I. The operator therefore provides the gain and the phase of the filter 46 for each frequency f, allowing canceling out of the perceived sound at the inner ear. By respectively noting as Hg the transfer function of the filter 46, $H_{TO}$ the transfer function of the transducer 8 and $H_{TA}$ the transfer function of the earphone 42, the following relationship is verified:

$$H_g \cdot H_{TO} H_{CO} = -H_{TA} \cdot {}_{CA} \quad \text{(Eq 5)}$$

Thus, the ratio $R=H_{CA}/H_{CO}$ is inferred therefrom:

$$\frac{H_{CA}}{H_{CO}} = -H_g \cdot \frac{H_{TO}}{H_{TA}} \quad \text{(Eq 6)}$$

The transfer function Hg is obtained by measurement as explained above and stored in memory, and the respective transfer functions of the transducer 8 and of the earphone 42 are known. Therefore, it is possible to calculate the ratio R.

Alternatively, the experimental procedure is repeated for a plurality of operators, thus giving the possibility of obtaining a plurality of subjective measurements for the transfer function Hg in the set of frequencies, and of inferring therefrom an average transfer function.

Thus, equation (Eq 4) allows determination of the transfer function $H_{FO}$ of the filter 32 to be applied in order to achieve canceling out of the ambient sound signal Sb, sensed by the microphone 40, by bone conduction via a transducer 8.

It should be noted that from a computing point of view, it is possible to combine equations (Eq 4) and (Eq 6), which gives the possibility of obtaining the following simplified relationship for obtaining the transfer function $H_{FO}$ of the filter 32:

$$H_{FO} = \frac{H_g}{H_m \cdot H_{TA}} \cdot H_b^G \quad \text{(Eq 7)}$$

The transfer function $H_{FO}$ may therefore be calculated by applying equation (Eq 7) above, wherein $H_g$ is the transfer function as measured above. The transfer functions $H_m \cdot H_{TA}$ and $H_b^G$ are determined in a known way in the field of active noise reduction, by means of an acoustic dummy in an acoustic chamber, with a frequency sweep from 20 Hz to 20,000 Hz.

According to a second embodiment, in the noise reduction acoustic device including two noise reduction acoustic modules 4, a suitable transfer function is applied, taking into account transverse bone propagation, i.e. bone conduction of the vibratory signal transmitted by the transducer located on the left as far as the right inner ear of the user, and vice-versa, a bone conduction of the vibratory signal transmitted by the right transducer as far as the left inner ear.

Figure 5:
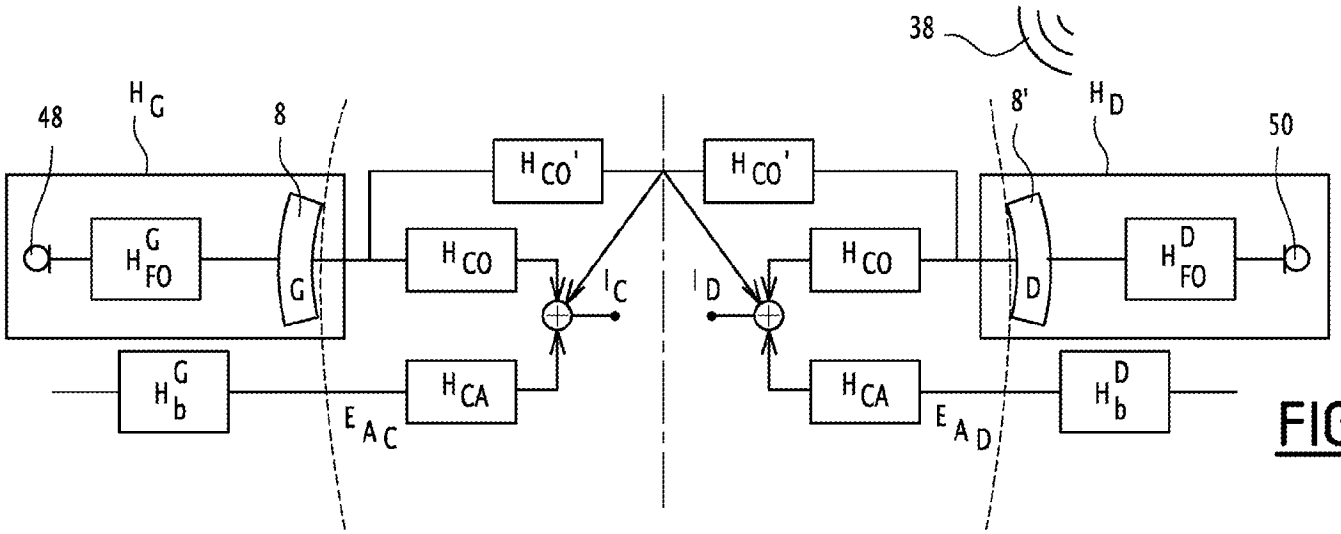
FIG. 5 is a block diagram of active noise reduction according to a second embodiment.

Similarly to FIG. 3, FIG. 5 schematically illustrates the principle for noise reduction via an osteophonic route in this second embodiment.

Two similar transducers 8, 8' and having a same transfer function $H_{TO}$ are considered, respectively noted as G for the left transducer positioned on the left side portion of the skull of the user and D for the right transducer positioned on the right side portion of the skull of the user. The points $I_G$ and $I_D$ respectively designate the input points to the left and right inner ear of the user, and the points $E_G$ and $E_D$ the respective input points of the entries to the left and right outer auditory conduits. It is assumed that the internal auditory conduits on the one hand and bone conduction on the other hand are symmetrical for an average user, therefore a single transfer function $H_{CO}$ of direct bone conduction, $H_{CO}'$ of transverse bone conduction and $H_{CA}$ of airborne conduction of the medium ear and of the inner ear are considered.

Exteriorly, in terms of great grand generality, it is considered that the left and right respective transfer functions corresponding to the noisy environment may be different, and different filtering $H_{FO}^G$ and $H_{FO}^D$ is applied at the input of the respective transducers 8, 8'. A microphone 48 is connected to the left transducer 8 and a microphone 50 is connected to the right transducer 8'.

In order to obtain simultaneously canceling out of the perceived noise at both inner ears, the following relationships are verified:

$$H_G \cdot H_{CO} + H_b^G \cdot H_{CA} + H'_{CO} \cdot H_D = 0 \quad \text{(Eq 8)}$$

$$H_D \cdot H_{CO} + H_b^D \cdot H_{CA} + H'_{CO} \cdot H_G = 0 \quad \text{(Eq 9)}$$

By calculation, are then obtained:

$$H_D = \frac{R}{(1-P^2)} \cdot [H_b^G \cdot P - H_b^D] \quad \text{(Eq 10)}$$

$$H_G = \frac{R}{(1-P^2)} \cdot [H_b^D \cdot P - H_b^G] \quad \text{(Eq 11)}$$

Wherein $$R = \frac{H_{CA}}{H_{CO}}$$

as earlier, and $$P = \frac{H'_{CO}}{H_{CO}}$$

is the ratio between the transfer function of transverse bone conduction and of transfer function of direct bone conduction.

If it is considered that the transfer functions $H_b^G$ and $H_b^D$ are identical: $H_b^G = H_b^D = H_b$, the equations (Eq 10) and (Eq 11) are simplified as follows:

$$H_D = H_G = -\frac{R}{1+P} \cdot H_b \quad \text{(Eq 12)}$$

In order to determine the transfer functions, it is useful to determine the ratio P of the respective direct and transverse bone conduction transfer functions. In an embodiment, the following relationship is used:

$$P = \frac{H'_{CO}}{H_{CA}} \cdot R \quad \text{(Eq 13)}$$

Thus, it is sufficient to determine $P'=H'_{CO}/H_{CA}$, a ratio which may be experimentally measured, in a similar way to the experimental procedure described above with reference to FIG. 4.

Figure 6:
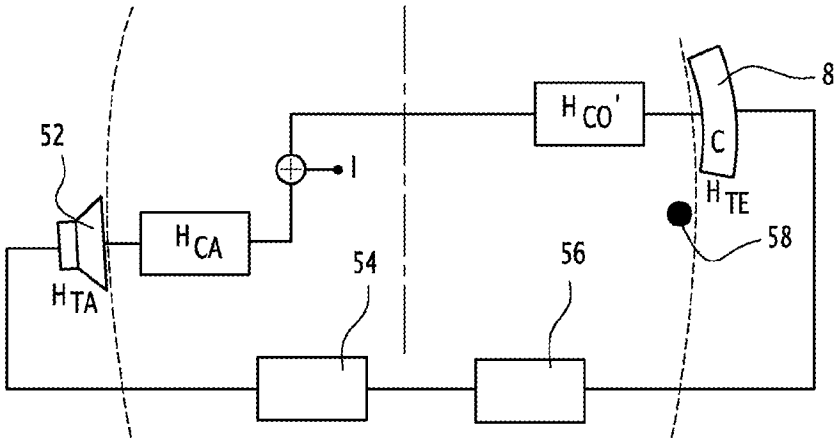
FIG. 6 schematically illustrates a procedure for measuring the transverse bone conduction transfer function.

A schematic illustration of a procedure for determining the ratio P' is illustrated in FIG. 6. In the embodiment of FIG. 6, the earphone 52 is placed on the opposite side of the osteophonic transducer 8. The conduit of the outer ear on the same side as the osteophonic transducer 8 is obstructed by an earplug 58 for example, in order to avoid any interference.

A generator 54 of sinusoidal signals, similar to the generator 44 of FIG. 4, gives the possibility of successively generating signals for a set of frequencies varying from 20 Hz to 20 kHz. A generated sinusoidal signal is both transmitted to the earphone 52 and to a filter 56, for which the gain $G'_o$, and the phase $\Delta\Phi o'o$ are adjustable by the operator. The operator has the possibility of adjusting the gain and the phase of the filter 56 for a sinusoidal signal of a given frequency f until he/she ascertains canceling out of the perceived sound at his/her inner ear I. The operator therefore provides the gain and the phase of the filter 56 for each frequency f, allowing canceling out of the perceived sound at the inner ear, between the sound signal provided via the earphone 52 and the vibratory signal transmitted by bone conduction from the transducer 8. By noting as $H'_g$ the transfer function of the filter 56, $H_{TO}$, the transfer function of the transducer 8 and $H_{TA}$, the transfer function of the earphone 52, the following relationship is verified:

$$H_{TA} \cdot H_{CA} = H_g \cdot H_{TO} \cdot H'_{CO} \quad \text{(Eq 14)}$$

The ratio P' is inferred therefrom with:

$$P' = -\frac{H_{TA}}{H'_g \cdot H_{TO}} \quad \text{(Eq 15)}$$

The function $H'_g$ is provided by experimental measurements, for a set of values of frequencies in the relevant frequency band. The ratio P' may then be calculated for this set of frequencies by means of the relationship provided by the equation (Eq 15), with knowledge of the respective transfer functions of the earphone 52 and of the transducer 8. Next, it is possible to infer therefrom the transfer functions $H_{FO}{}^G$ and $H_{FO}{}^D$ to be implemented by the respective filters of the electronic cards associated with each acoustic module 4.

It should be noted that the transfer functions $H_{FO}{}^G$ and $H_{FO}{}^G$ may be directly calculated with the following formulae, by using the ratio $$Q = \frac{H_g}{H'_g},$$

$H_g$ and $H_g'$ being the transfer functions of the respective filters 42 and 52, experimentally determined as discussed above.

$$H_{FO}^D = \left[\frac{-H_g}{H_m \cdot H_{TA}(1-Q^2)}\right] \cdot [H_b^G Q - H_b^D] \quad \text{(Eq 16)}$$

$$H_{FO}^G = \left[\frac{-H_g}{H_m \cdot H_{TA}(1-Q^2)}\right] \cdot [H_b^D Q - H_b^G] \quad \text{(Eq 17)}$$

Figure 7:
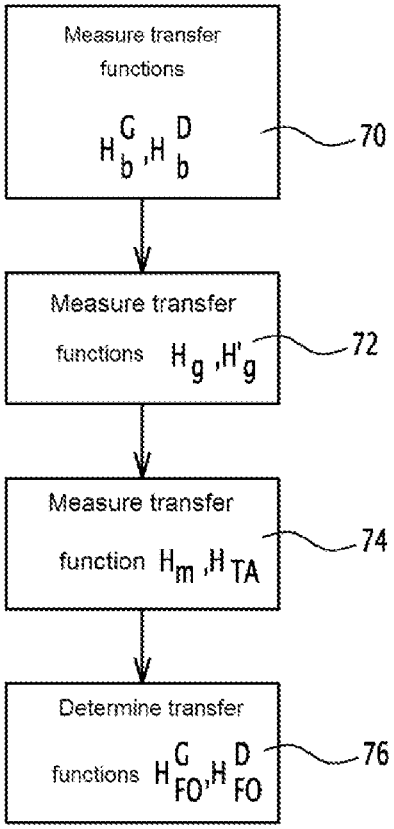
FIG. 7 is a flow chart of the main steps of a method for determining active noise reduction transfer functions via an osteophonic route.

The transfer functions $H_{FO}{}^G$ and $H_{FO}{}^D$ are obtained, according to an embodiment of the invention, by applying a determination method for which the main steps are illustrated in FIG. 7.

In a first step 70, the transfer functions $H_b{}^G$ and $H_b{}^D$ representative of the characteristics of the environment are calculated, according to a standard measurement procedure in an acoustic chamber as shortly explained above.

Next, the transfer functions $H_g$ and $H_g'$ are evaluated in the following step 72, according to for example the procedures described with reference to FIGS. 4 and 6.

In step 74, the combined transfer function $H_m \cdot H_{TA}$ is evaluated, according to a standard measurement procedure in an acoustic chamber as shortly described above.

Steps 70, 72 and 74 may be carried out in a different order. The determined transfer functions are stored in memory in a memory associated with a computing processor for the whole of the frequencies of the desired frequency interval.

Next, in step 76, the transfer functions $H_{FO}{}^G$ and $H_{FO}{}^D$ are determined by calculation, by using the relationships (Eq 16) and (Eq 17) above.

The thereby determined respective transfer functions are each implemented into an electronic filtering circuit of a filtering card of an osteophonic noise reduction acoustic module.

The invention claimed is:

1. An acoustic device capable of producing active noise reduction, which may be positioned on the head of a user, comprising at least one microphone able to sense a representative sound signal of ambient noise, wherein the acoustic device comprises at least one acoustic module for active noise reduction comprising an osteophonic transducer, capable of being positioned on a side flank of the head of the user and of transmitting a vibratory signal transformed by bone conduction into an acoustic signal which may be perceived by the user, wherein said acoustic module is connected to said at least one microphone, and wherein said at least one acoustic module includes an electronic circuit capable of generating a vibratory signal giving the possibility of attenuating the perception of said ambient noise by the user;

wherein said electronic circuit implements a filter defined by a transfer function for noise reduction, said transfer function being determined in order to produce noise attenuation according to direct bone conduction between the osteophonic transducer and an inner ear of the user located on a same side flank of the head of the user as said transducer; and wherein said transfer function is defined by the formula:

$$H_{FO} = -R \cdot \frac{H_b^G}{H_m \cdot H_{TO}}$$

wherein R is a ratio of a direct bone conduction transfer function and of an airborne conduction transfer function, $H_b^G$ is a characteristic transfer function of ambient noise, $H_m$ is a transfer function of said microphone, and $H_{TO}$ is a transfer function of said osteophonic transducer.

2. The acoustic device according to claim 1, wherein said direct bone conduction transfer function is representative of said bone conduction between the osteophonic transducer and the inner ear and said airborne conduction transfer function is representative of the conduction of an airborne acoustic signal between an outer ear and its corresponding inner ear.

3. The acoustic device according to claim 1, wherein the acoustic device further comprises a second acoustic module for active noise reduction capable of being positioned on the opposite side flank of the head of the user.

4. The acoustic device according to claim 3, wherein each acoustic module for active noise reduction includes an osteophonic transducer and an electronic circuit implementing a filter defined by a transfer function for noise reduction, said transfer function being determined according to direct bone conduction and transverse bone conduction of a vibratory signal from the opposite osteophonic transducer.

5. The acoustic device according to claim 1, wherein the acoustic device further includes an active noise reduction module for transmitting an airborne counter-noise signal.

* * * * *